US009648928B2

(12) United States Patent
Hatanaka et al.

(10) Patent No.: US 9,648,928 B2
(45) Date of Patent: May 16, 2017

(54) EXPANDABLE BAND

(71) Applicant: Apple Inc., Cupertino, CA (US)

(72) Inventors: Motohide Hatanaka, Tokyo-to (JP); Douglas J. Weber, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/668,120

(22) Filed: Mar. 25, 2015

(65) Prior Publication Data

US 2016/0255922 A1 Sep. 8, 2016

Related U.S. Application Data

(60) Provisional application No. 62/129,513, filed on Mar. 6, 2015.

(51) Int. Cl.
*A44C 5/06* (2006.01)

(52) U.S. Cl.
CPC ..... *A44C 5/06* (2013.01)

(58) Field of Classification Search
CPC .... A44C 5/06; A44C 5/02; A44C 5/04; A44C 5/18; A44C 5/22; A44C 25/00
USPC ..... 63/5.1, 9, 38
See application file for complete search history.

(56) References Cited

U.S. PATENT DOCUMENTS 1,797,583 A 3/1931 Miller
2,032,831 A * 3/1936 Blackinton ..... A44C 5/06 59/69
2,388,554 A 11/1945 Kreisler et al.
2,564,652 A 8/1951 Templeman
2,613,415 A 10/1952 Ritter
2,648,884 A 8/1953 Loofboro
2,696,689 A 12/1954 Speck et al.
2,901,895 A * 9/1959 Augenstein ..... A44C 5/06 24/71 J
2,919,539 A * 1/1960 Simonetti ..... A44C 5/06 59/79.1
3,009,314 A * 11/1961 Meyerson ..... A44C 5/06 24/630

(Continued)

FOREIGN PATENT DOCUMENTS

CN 201393583 2/2010
DE 202012102780 11/2012

(Continued)

*Primary Examiner* — Emily Morgan
(74) *Attorney, Agent, or Firm* — Sterne, Kessler, Goldstein & Fox P.L.L.C.

(57) ABSTRACT

An expandable band includes one or more expandable links and one or more expansion mechanisms. The expandable link is movable between expanded and contracted positions. The expandable link is biased toward the contracted position. The expansion mechanism can be manipulated to transition the expandable link between the expanded and contracted positions, thus expanding and/or contracting the expandable band. The expandable links may be X links, pantographs, and/or other linkages. The expansion mechanism may include one or more restrictors operable to restrict expansion of the expandable band. The expansion mechanism may also include one or more lock mechanisms operable to prevent and/or resist contracting of the expandable band.

12 Claims, 11 Drawing Sheets

(56) References Cited

U.S. PATENT DOCUMENTS

| | | | | | |
|---|---|---|---|---|---|
| 3,018,616 | A | * | 1/1962 | Ebert | A44C 5/06 24/630 |
| 3,082,595 | A | * | 3/1963 | Dodinat | A44C 5/06 29/417 |
| 3,135,086 | A | * | 6/1964 | Shibuya | A44C 5/06 59/79.1 |
| 3,173,240 | A | * | 3/1965 | Sang | A44C 5/06 227/51 |
| 3,677,450 | A | * | 7/1972 | Hodgson | A44C 5/0015 224/175 |
| 4,051,668 | A | | 10/1977 | Learn | |
| 4,941,236 | A | | 7/1990 | Sherman et al. | |
| 6,237,319 | B1 | | 5/2001 | Amundsen et al. | |
| 7,021,041 | B2 | | 4/2006 | Verdon et al. | |
| 8,191,209 | B2 | | 6/2012 | Wolfgang | |
| 8,567,172 | B2 | | 10/2013 | Asami | |
| 8,576,036 | B2 | | 11/2013 | Fullerton et al. | |
| 2009/0031757 | A1 | | 2/2009 | Harding | |
| 2014/0101899 | A1 | | 4/2014 | Moille | |
| 2015/0121668 | A1 | | 5/2015 | Kaltenrieder | |
| 2016/0037841 | A1 | | 2/2016 | Dey et al. | |
| 2016/0037874 | A1 | | 2/2016 | Webb et al. | |

FOREIGN PATENT DOCUMENTS

| | | |
|---|---|---|
| EP | 0040504 | 11/1981 |
| EP | 1980170 | 10/2008 |
| EP | 2260910 | 12/2010 |
| EP | 2679113 | 1/2014 |
| WO | WO0132045 | 5/2001 |
| WO | WO03056956 | 7/2003 |

* cited by examiner

EXPANDABLE BAND

CROSS-REFERENCE TO RELATED APPLICATION

This application is a nonprovisional patent application of and claims the benefit of U.S. Provisional Patent Application No. 62/129,513, filed Mar. 6, 2015 and titled "Expandable Band," the disclosure of which is hereby incorporated herein by reference in its entirety.

TECHNICAL FIELD

This disclosure relates generally to bands, and more specifically to a band that expands in response to manipulation of an expansion mechanism.

BACKGROUND

Various different bands are used for a variety of different purposes. Some bands may be used to attach devices such as wearable devices to a user. Other bands, such as bracelets, may be worn by users for purposes other than attaching devices to the user. Regardless of the purpose for which they are used, such bands generally are configured to stay on a user when in use and to be removable when being put on or taken off.

Some bands may include a detachment mechanism that separates a portion of the band. This may allow the band to be put on or taken off when separated yet stay on when joined. However, such a separated band may be easy to drop.

Other bands may include a mechanism such as a folding clasp. A folding clasp may be a band portion that is operable to shorten and lengthen by locking and unlocking a lever or other mechanism without separating the band. This may allow the band to stay on when shortened and put on or taken off when lengthened without risking the band being dropped. However, a folding clasp may not be particularly flexible in length. Further, the mechanisms used in the folding clasp may not be comfortable for a user.

SUMMARY

The present disclosure relates to expandable bands. An expandable band may include one or more expandable links and one or more expansion mechanisms. The expandable link may be movable between expanded and contracted positions. The expandable link may be biased toward the contracted position. The expansion mechanism may be manipulated to transition the expandable link between the expanded and contracted positions, thus expanding and/or contracting the expandable band.

In various implementations, an expandable band may include an expandable link having a first segment, a second segment, and a joint spring joining the first segment and the second segment and operable to transition the expandable link between an expanded position and a contracted position. The joint spring may be biased toward the contracted position. The expandable band may also include an expansion mechanism coupled to the expandable link having a first expansion mechanism member and a second expansion mechanism member spring mounted to the first expansion mechanism member. The first segment and the second segment may move via the joint spring to transition the expandable link between the expanded position and the contracted position in response to movement of the second expansion mechanism member relative to the first expansion mechanism member In some implementations, an expandable band may include an X linkage having a first bar, a second bar, and a joint movably connecting the first and second bar operable to expand and contract the X linkage. The joint may be biased towards contracting the X linkage. The expandable band system may also include a manipulation mechanism having a third bar movably coupled to the first bar and a fourth bar movably mounted parallel to the third bar and movably coupled to the second bar. Movement of the third and fourth bars towards each other may move the first and second bars causing the X linkage to expand.

In one or more implementations, an adjustable band may include an adjustment mechanism having a first member, a second member having a spring mounted in an aperture, and a post connected to the first member and the spring. Movement of the first and second members towards each other may cause the post to compress the spring. The adjustable band may also include a linkage connected to the adjustment mechanism having a third member, a fourth member, and a spring joint movably coupling the third and fourth members operable to expand the linkage when the first and second members move towards each other. The spring joint may be biased to contract the linkage.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

The description that follows includes sample systems, methods, and apparatuses that embody various elements of the present disclosure. However, it should be understood that the described disclosure may be practiced in a variety of forms in addition to those described herein.

The present disclosure relates to expandable bands. An expandable band may include or more expandable links and one or more expansion mechanisms. The expansion mechanisms may be operable to transition the expandable links between expanded and contracted positions. The expandable link may include multiple segments coupled by one or more joints moveable to transition the segments between expanded and contracted positions. The joints may be spring biased toward the contracted position. The expansion mechanism may include a number of expansion members movably mounted together. Movement of the expansion members with respect to each other may transfer the motion to the expandable links, transitioning the expandable links between the expanded and contracted positions. In this way, the expandable band may be expanded and/or contracted when desired yet may not expand and/or contract when this is not desired.

In various implementations, the expandable links may be configured as X links, pantographs, and/or other kinds of linkages. In one or more implementations, the expandable band may include one or more attachment mechanisms operable to attach the expandable band to a wearable device and/or other object.

In some implementations, the expandable band may include one or more restrictors and/or lock mechanisms. The restrictor may limit a maximum separation distance between members of the expansion mechanism and thereby limit how far toward the contracted position that the expandable band may move. The lock mechanism may prevent and/or restrict motion of the members of the expansion mechanism with respect to each other and thereby limit how far toward the expandable position the expandable band may move, and/or whether the expandable band is able to expand at all. Such restrictors and/or lock mechanisms may be adjustable such that the expandable band may expand and/or contract when being put on or taken off but not expand and/or contract (and/or limit the expansion and/or contraction) during use.

In various implementations, the expandable band may include one or more band segments, such as one or more adjustable length band segments. In some implementations, an adjustable length band segment may include one or more extender links that may be added and/or removed to adjust the length of the adjustable length band segment.

Figure 1A:
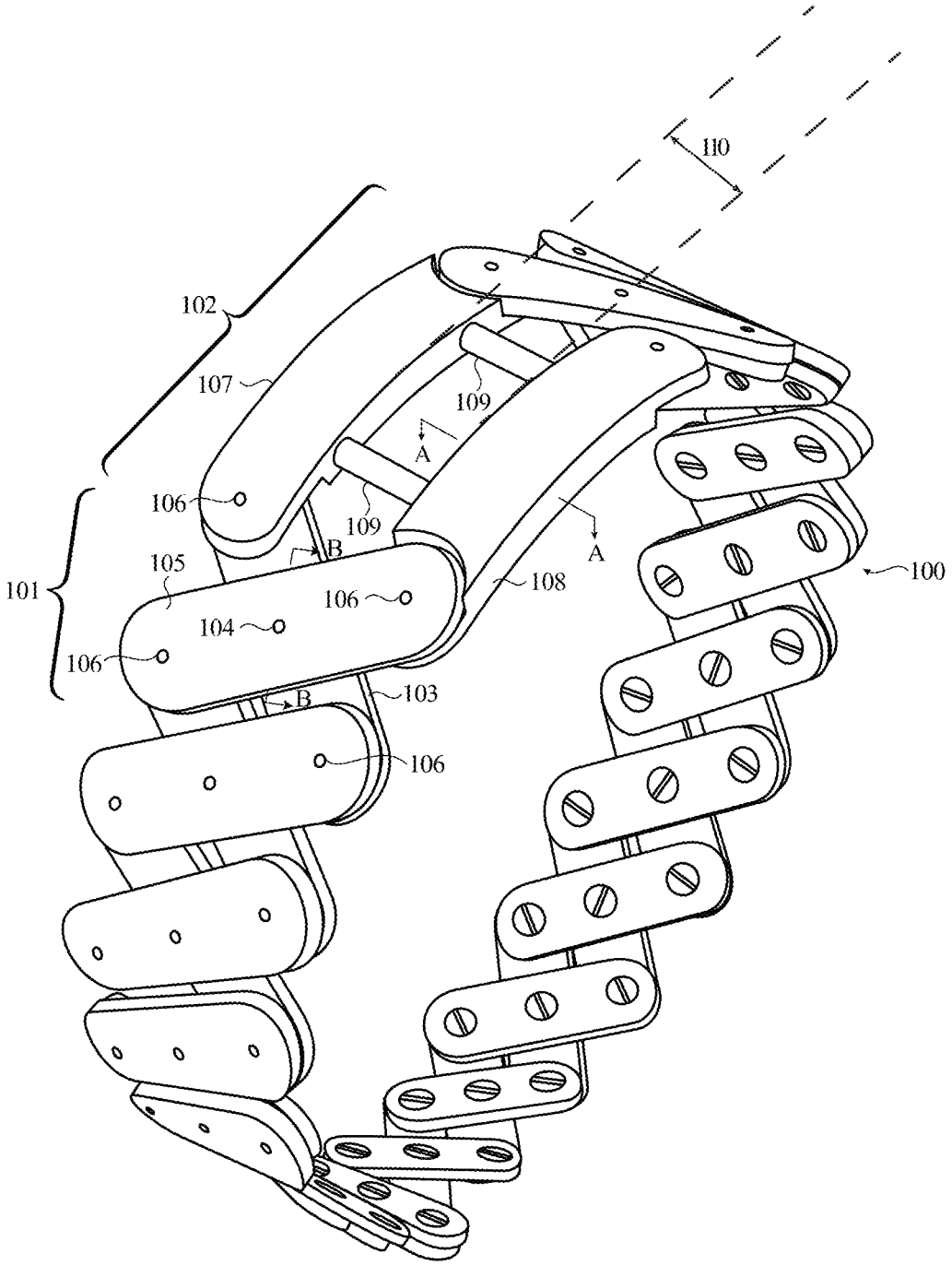
FIG. 1A is an isometric view of a first implementation of a first example expandable band.

FIG. 1A is an isometric view of a first implementation of a first example expandable band 100. As illustrated, the expandable band 100 may include one or more expandable links 101 and one or more expansion mechanisms 102. The expandable link 101 may include a first segment 103 coupled to a second segment 105 by a joint 104. The joint may allow the first and second segments 103 and 105 to move in order to transition the expandable link 101 between a contracted position (shown in FIG. 1A) and an expanded position (shown in FIG. 1B). The expansion mechanism 102 may include a first expansion mechanism member 107 movably coupled to a second expansion mechanism member 108. The first and second expansion mechanism members 107 and 108 may be coupled respectively to the first and second segments 103 and 105 by joints 106 such that movement of the first and second expansion mechanism members 107 and 108 with respect to each other moves the first and second segments 103 and 105 to transition the expandable link 101 between a contracted position shown in FIG. 1A and an expanded position shown in FIG. 1B.

Figure 1B:
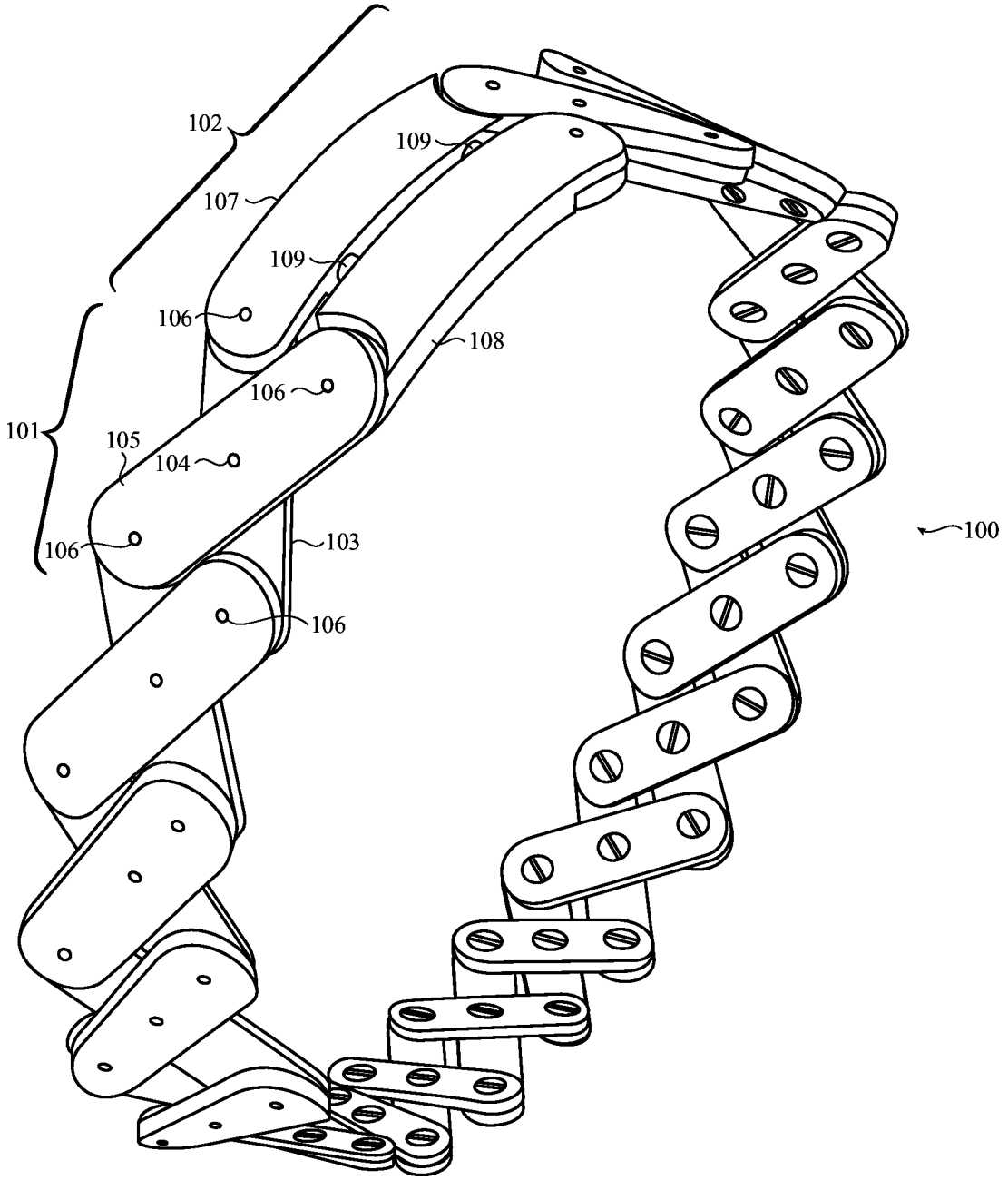
FIG. 1B illustrates the first implementation of the first example expandable band expanded.

As shown in FIGS. 1A and 1B, movement of the first and second expansion mechanism members 107 and 108 towards each other may transition the expandable link 101 toward the expanded position. Conversely, movement of the first and second expansion mechanism members 107 and 108 away from each other may transition the expandable link 101 toward the contracted position. Thus, the expansion mechanism 102 may be manipulated to expand the expandable band 100 when being put on and/or taken off of a user and/or to the expandable band 100 to contract such that the expandable band 100 stays on when worn by a user.

The joint 104 and/or the joints 106 may be a variety of different kinds of joints. A ball joint, a pin joint, and so on may be utilized. In some implementations, the joint 104 and/or the joints 106 may be spring loaded. Such spring loading may bias the joint 104 and/or the joints 106 in a particular direction and/or toward a particular position.

Figure 3:
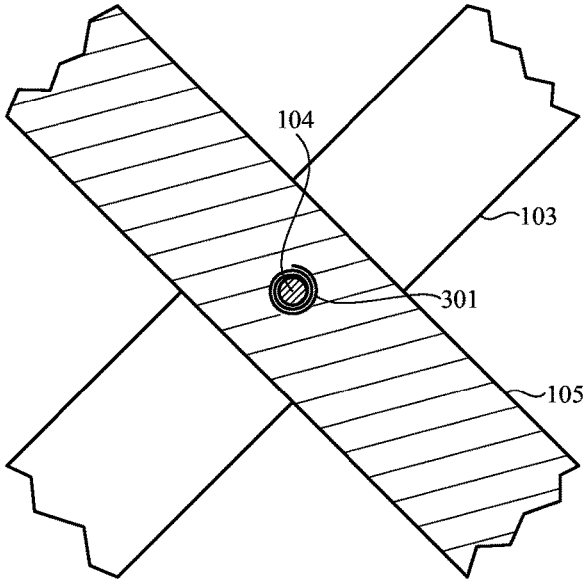
FIG. 3 is a cross-sectional view of the joint of the first implementation of the first example expandable band of FIG. 1A, taken along line B-B of FIG. 1A.

For example, FIG. 3 is a cross-sectional view of the joint 104 of FIG. 1A, taken along line B-B of FIG. 1A. As illustrated, the joint 104 may include a spring 301, which may be a torsion spring and/or any other spring mechanism. The spring 301 may bias the first and second segments 103 and 105, and thus the expandable link 101, towards the contracted position.

Figure 2:
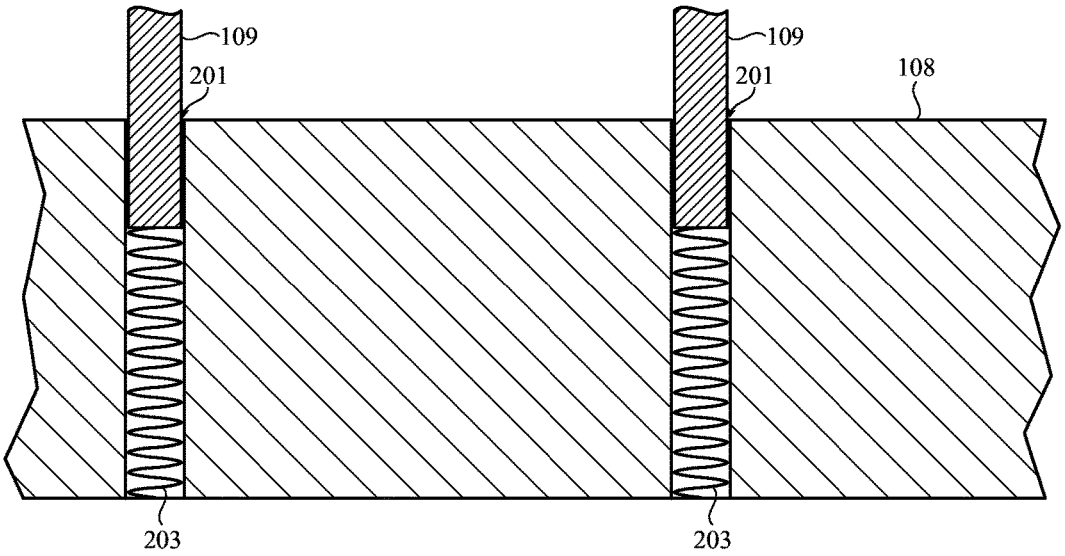
FIG. 2 is a cross-sectional view of the second expansion mechanism member of the first implementation of the first example expandable band of FIG. 1A, taken along line A-A of FIG. 1A.

Returning to FIG. 1A, the first expansion mechanism member 107 of the expansion mechanism 102 may be movably coupled parallel to the second expansion mechanism member 108 via posts 109 and one or more springs. For example, FIG. 2 is a cross-sectional view of the second expansion mechanism member 108 of FIG. 1A, taken along line A-A of FIG. 1A. As illustrated, the second expansion mechanism member 108 may include springs 203 that are mounted in apertures 201 and connected to the posts 109, biasing the first and second expansion mechanism members 107 and 108 away from each other. Movement of the posts 109 may compress/decompress the springs 203 such that the first and second expansion mechanism members 107 and 108 are able to move closer and further apart. Movement of the first and second expansion mechanism members 107 and 108 toward each other causes the posts 109 to compress the springs 203 (and may cause portions of the posts 109 to at least partially enter the apertures 201). In this example, the posts 109 may be fixedly attached to the first expansion mechanism member 107 and/or attached via springs similar to the springs 203 of the second expansion mechanism member 108. However, it is understood that these are examples and that the first and second expansion mechanism members 107 and 108 may be movably attached using other mechanisms without departing from the scope of the present disclosure.

Returning to FIGS. 1A and 1B, exertion of force causing movement of the first and second expansion mechanism members 107 and 108 toward each other may transfer the movement via the joints 106 to the first and second segments 103 and 105 of the expansion link 101. The first and second segments 103 and 105 may move in response along the joint 104 toward the contracted position. The first and second segments 103 and 105 may also transfer the motion in response to further connected expansion links, as shown in FIG. 1B. When force is no longer exerted on the first and second expansion mechanism members 107 and 108, the spring bias of the joint 104 may return the expansion link 101 toward the contracted position as shown in FIG. 1A. The first and second segments 103 and 105 may transfer such movement to the first and second expansion mechanism members 107 and 108 via the joints 106, moving the first and second expansion mechanism members 107 and 108 further apart.

Although the above describes expansion of the expandable band 100 occurring in response to manipulation of the expansion mechanism 102, it is understood that this is an example. The expandable band 100 may also be operable to expand when another force is exerted to stretch the expandable band 100 (i.e., stretching of the expandable band expands the linkages of the expansion links 101). In such a case, the spring bias of the joints 104 may return the expandable band to the contracted state when such a force is no longer exerted.

Further, the expansion mechanism 102 is illustrated and described above as including first and second expansion mechanism members 107 and 108 formed as parallel bars (which may be formed of various materials such as metal, plastic, and so on). However, it is understood that this is an example. In various implementations, the first and second expansion mechanism members 107 and 108 may be formed as a variety of members in a variety of different configurations without departing from the scope of the present disclosure.

Additionally, though the expansion mechanism 102 is illustrated and described above as operating in a particular fashion, it is understood that this is an example. In various implementations, variously configured expansion mechanisms, manipulation mechanisms, adjustment mechanisms, and so on may operate in a variety of different fashions without departing from the scope of the present disclosure. For example, in some implementations a manipulation mechanism may be operable to move the expandable band 100 to an expanded position when bars or other members of the manipulation mechanism are moved away from each other and to a contracted position when the bars or other members are moved closer to each other. Various configurations are possible and contemplated without departing from the scope of the present disclosure.

In various implementations, the expandable band 100 may include one or more restrictors that limit how far apart (e.g., configure maximum separation distance 110 between) the first and second expansion mechanism members 107 and 108 can move with respect to each other. As movement of the first and second expansion mechanism members 107 and 108 away from each other allows the expandable link 101 to move toward the contracted position, such a restrictor may limit how far the expandable band 100 may contract.

Figure 4:
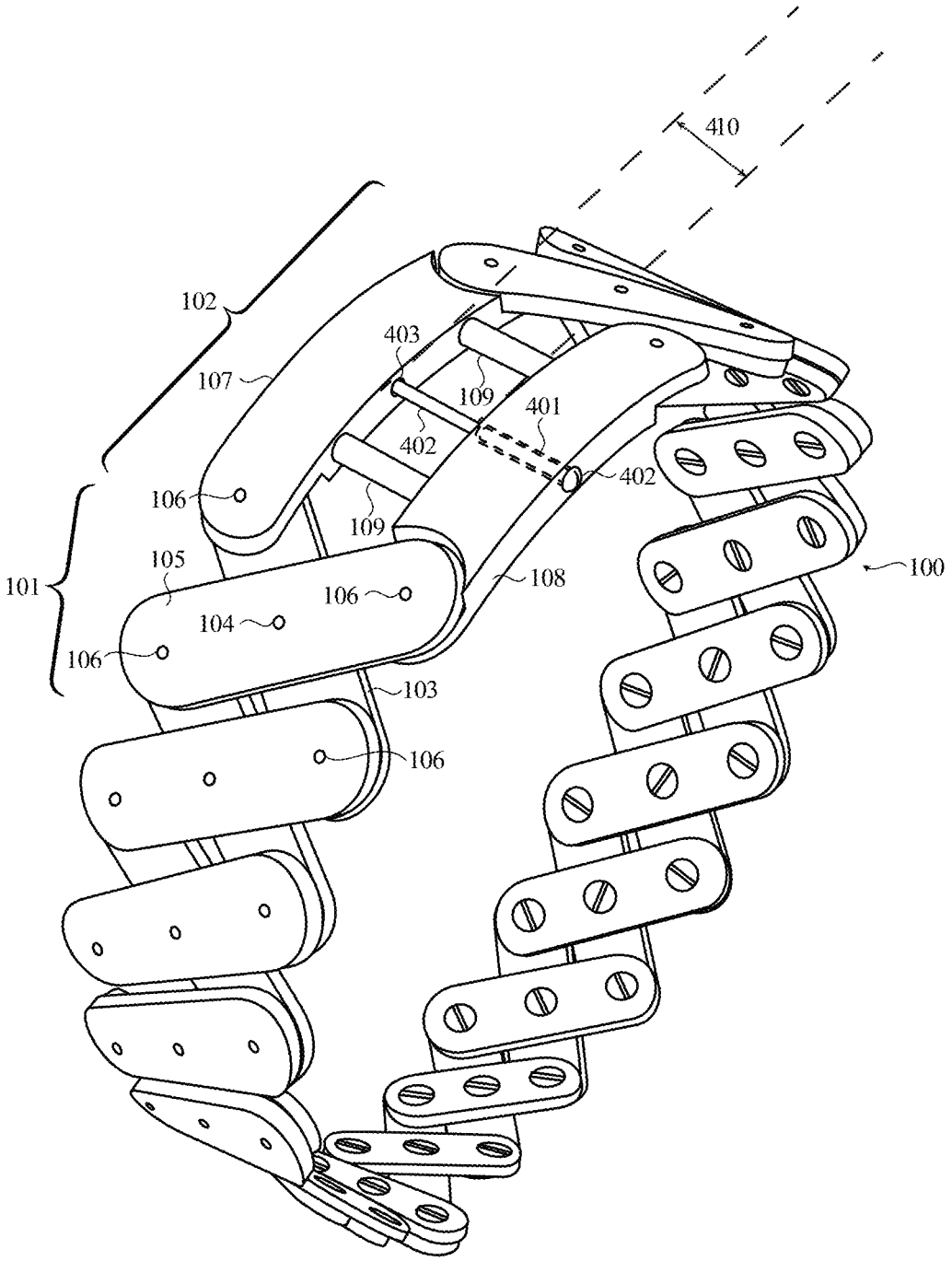
FIG. 4 is an isometric view of a second implementation of the first example expandable band.

For example, FIG. 4 is an isometric view of a second implementation of the first example expandable band 100 including a restrictor. In this implementation, the restrictor may be implemented as a screw 403 that is configured to pass through a hole 401 the second expansion mechanism member 108 and couple to a threaded hole 402 the first expansion mechanism member 107. As the screw 403 may pass through the second expansion mechanism member 108 and couple to the first expansion mechanism member 107, the second expansion mechanism member 108 may be operable to move along the screw 403 to move towards the first expansion mechanism member 107. However, the screw 403 may prevent the second expansion mechanism member 108 from moving away from the first expansion mechanism member 107 beyond the head of the screw 403. Thus, the length of the screw 403 may define maximum separation distance 410 (a set distance) that the first and second expansion mechanism members 107 and 108 may travel with respect to each other. As shown, maximum separation distance 410 between the first expansion mechanism member 107 and the second expansion mechanism member 108 limits movement of the expandable link 101 toward the contracted position.

In some implementations, the maximum separation distance 410 may be adjustable. For example, maximum separation distance 410 defined by the length of the screw 403 may be decreased by screwing the screw 403 further into the threaded hole 402. By way of another example, maximum separation distance 410 defined by the length of the screw 403 may be decreased by screwing the screw 403 further out of the threaded hole 402.

In various implementations, the expandable band 100 may include one or more lock mechanisms that limit close the first and second expansion mechanism members 107 and 108 can move with respect to each other. As movement of the first and second expansion mechanism members 107 and 108 toward each other allows the expandable link 101 to move toward the expanded position, such a lock mechanism may limit how far the expandable band 100 may expand and/or whether or not the expandable band 100 may expand.

Figure 5A:
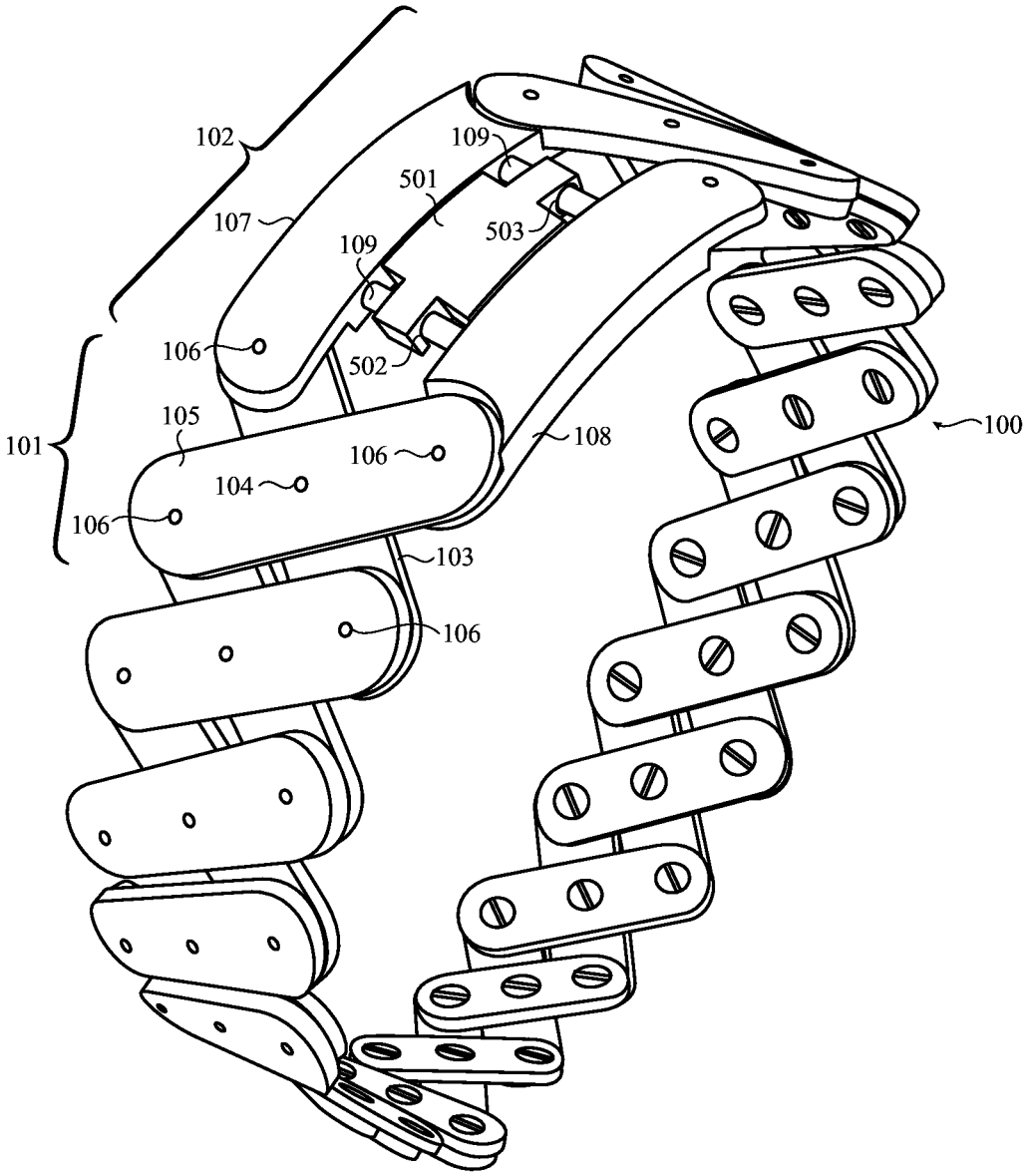
FIG. 5A is an isometric view of a third implementation of the first example expandable band.

For example, FIG. 5A is an isometric view of a third implementation of the first example expandable band 100 including a lock mechanism. In this implementation, the lock mechanism may be implemented as a tab 501 movably mounted to the posts 109 in the gap between the first and second expansion mechanism members 107 and 108. As illustrated, the tab 501 may be operable to be positioned in the gap such that the first and second expansion mechanism members 107 and 108 are prevented and/or restricted from moving towards each other. As such, the tab 501 may prevent the expandable band 100 from moving toward the expanded position.

In this implementation, the tab 501 may include an aperture 503 that surrounds one of the posts 109 so that the tab 501 may be rotated in (shown in FIG. 5A) and out (shown in FIG. 5B) of the gap between the first and second expansion mechanism members 107 and 108. The tab 501 may also include a catch 502 that is operable to lock to one of the posts 109 such that the tab 501 is lockable in place in the gap. As such, the tab 501 may be rotated in and out of the gap and fixed in place to allow the expandable band 100 to expand when being put on or removed and to prevent expansion during use.

Figure 5B:
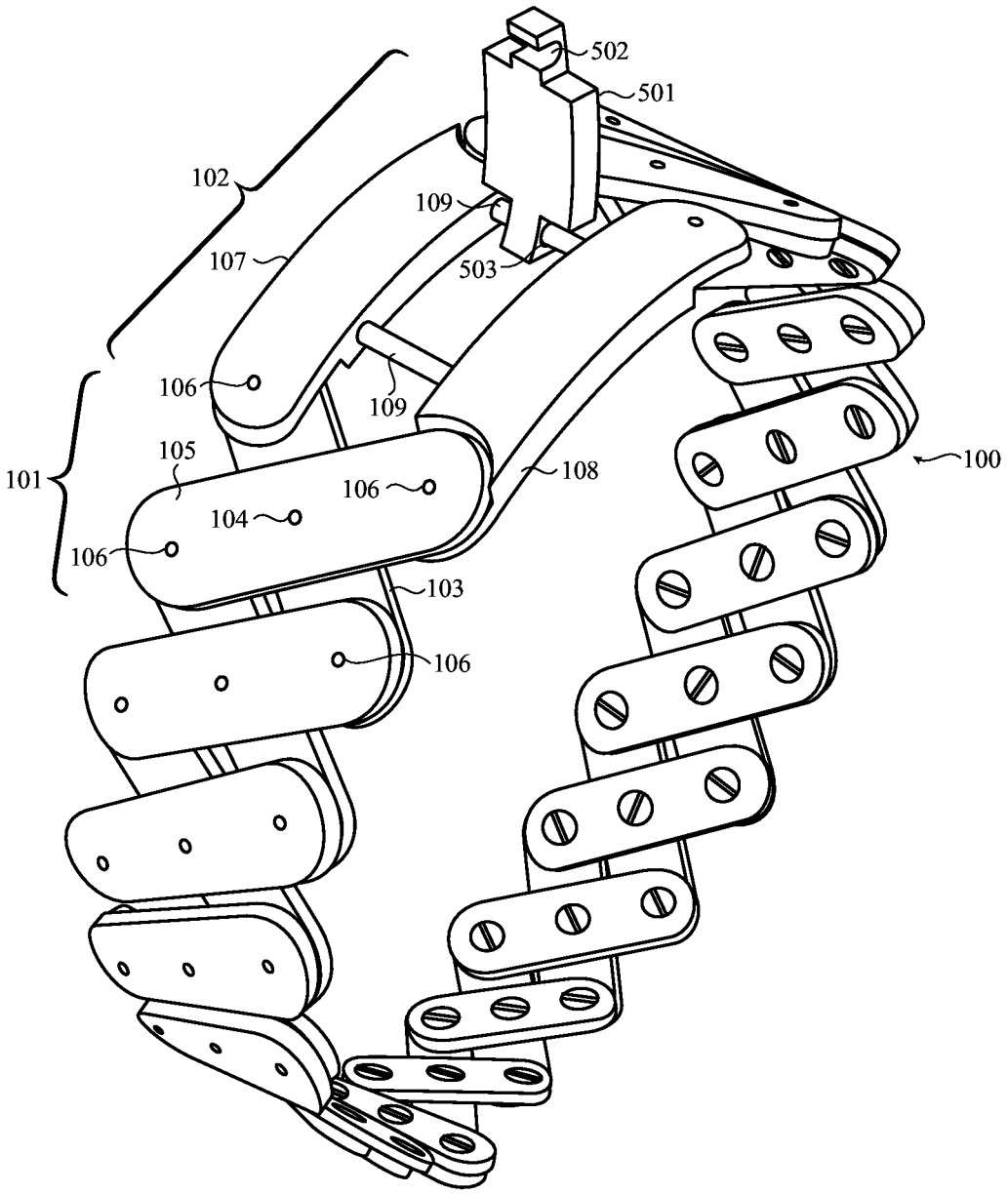
FIG. 5B illustrates the third implementation of the first example band of FIG. 5A with the lock mechanism moved to an unlocked position.

Although FIGS. 4 and 5A-5B are illustrated and described above as separate implementations, it is understood that these are examples. In various implementations, both restrictors and lock mechanisms may be utilized without departing from the scope of the present disclosure. Such mechanisms may be combined in order to allow expansion and/or when the expandable band 100 is being taken off or put on and/or to prevent expansion and/or contraction of the expandable band 100 when in use.

Figure 6:
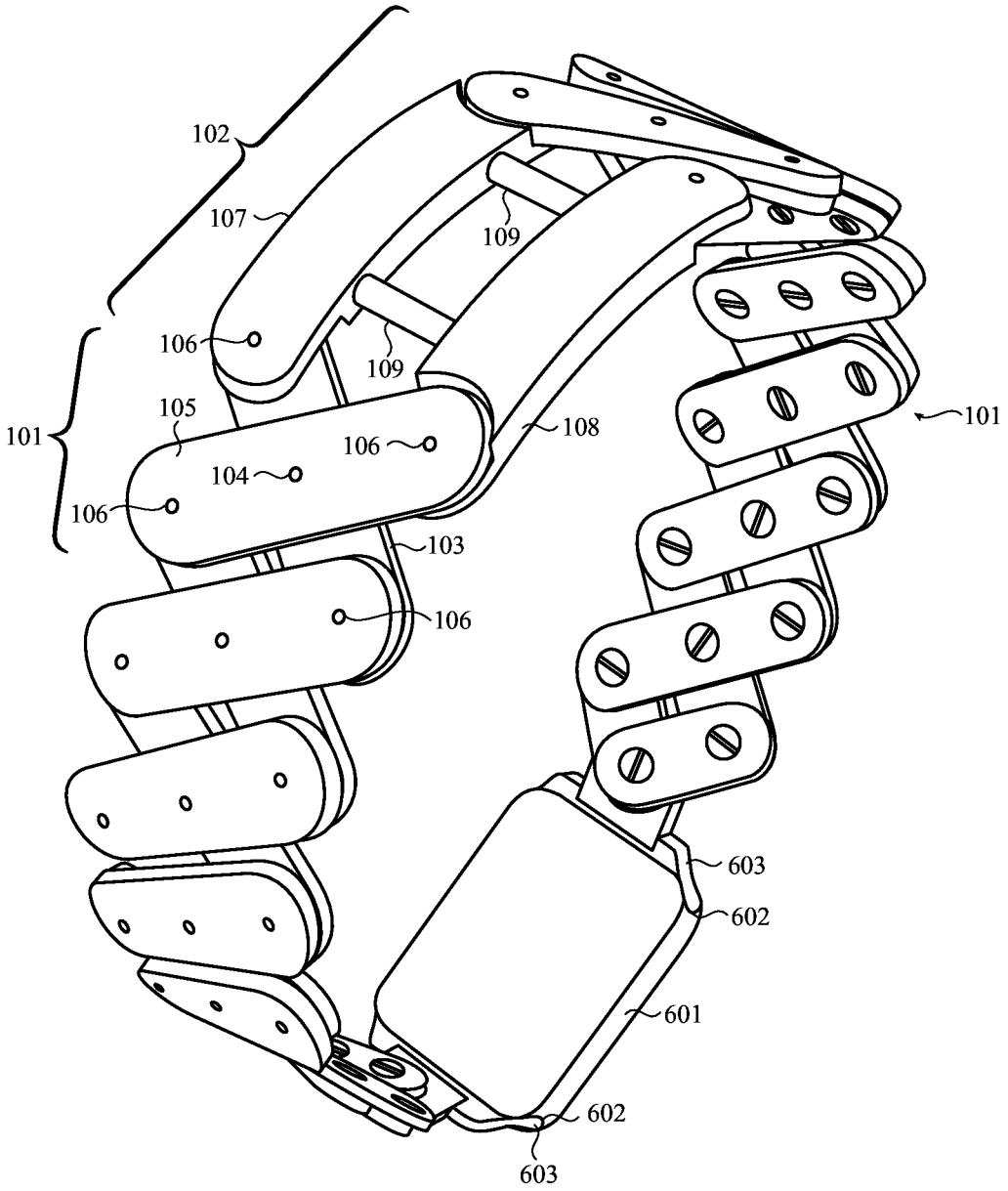
FIG. 6 is an isometric view of a fourth implementation of the first example expandable band.

In various implementations, the expandable band 100 may be utilized as an attachment member that is operable to attach one or more devices to a user and/or other objects. For example, FIG. 6 is an isometric view of a fourth implementation of the first example expandable band 100 where the expandable band 100 is configured to attach to a wearable device 601.

As illustrated, the expandable band 100 may include one or more attachment mechanisms 603 that are attachable to attachment points 602 of the wearable device 601. Thus, the expandable band 100 may be operable at an attachment member to attach the wearable device 601 to a user and/or other objects.

Although a particular wearable device 601 is illustrated, it is understood that any kind of wearable device may be utilized. Though not shown, the wearable device 601may include a variety of different components. Such components may include one or more processing units, one or more communication components, one or more user interface components, one or more input/output components, one or more non-transitory storage media (which may take the form of, but is not limited to, a magnetic storage medium; optical storage medium; magneto-optical storage medium; read only memory; random access memory; erasable programmable memory; flash memory; and so on), and so on.

Further, in various implementations the expandable band 100 may include one or more electronic and/or other components as described above with respect to the wearable device 601. In such implementations, the attachment points 602, the attachment mechanisms 603, and/or other components of the wearable device 601 and/or the expandable band 100 may electrically, mechanically, and/or communicably connect wearable device 601 (or components thereof) and the expandable band 100 (or components thereof) and/or so connect the wearable device 601 and/or the expandable band 100 to other devices. Various configurations are possible and contemplated without departing from the scope of the present disclosure.

Returning to FIGS. 1A-1B, the expandable link 101 is shown as an X link or linkage wherein the X link is formed by the first and second segments 103 and 105 joined by the joint 104 coupled to at least one additional X linkage. As shown, the first and second segments 103 and 105 may be bars or other members (which may be formed of various materials such as metal, plastic, and so on) and the X link may operate as a pantograph (a mechanical linkage connected in a manner based on parallelograms such that different joints of the mechanical linkage move similarly when the mechanical linkage is manipulated). However, it is understood that this is an example and that the expandable link 101 may be otherwise configured without departing from the scope of the present disclosure.

Figure 7:
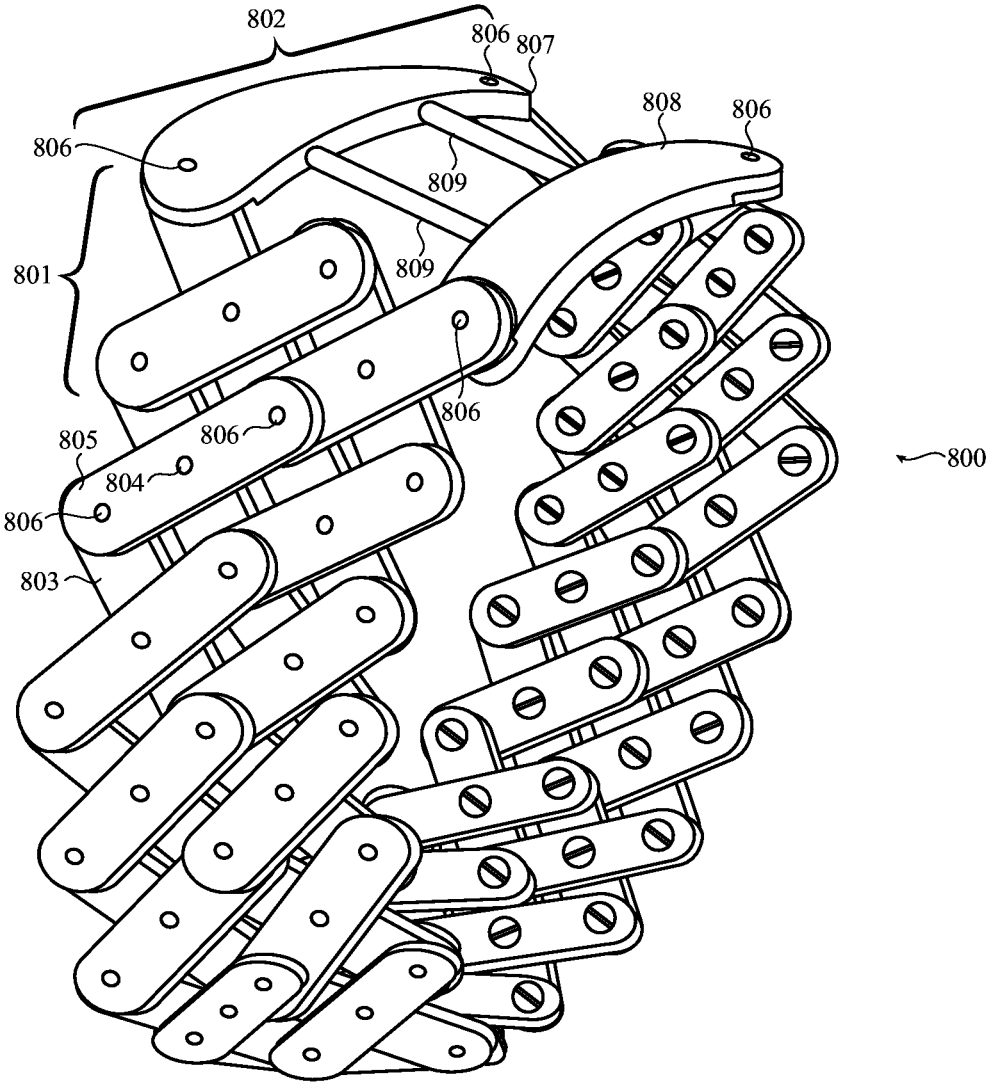
FIG. 7 is an isometric view of a second example expandable band.

For example, FIG. 7 is an isometric view of a second example expandable band 800. As contrasted with the X link expandable links 101 shown connected in series in the example expandable band 100 of FIGS. 1A-1B, the expandable band 800 may include multiple rows of X links connected in parallel.

Returning again to FIGS. 1A-1B, although the expandable band 100 is illustrated and described above as including the expandable links 101 and the expansion mechanisms 102, the expandable band 100 may also include various other components such as one or more band segments without departing from the scope of the present disclosure.

Figure 8A:
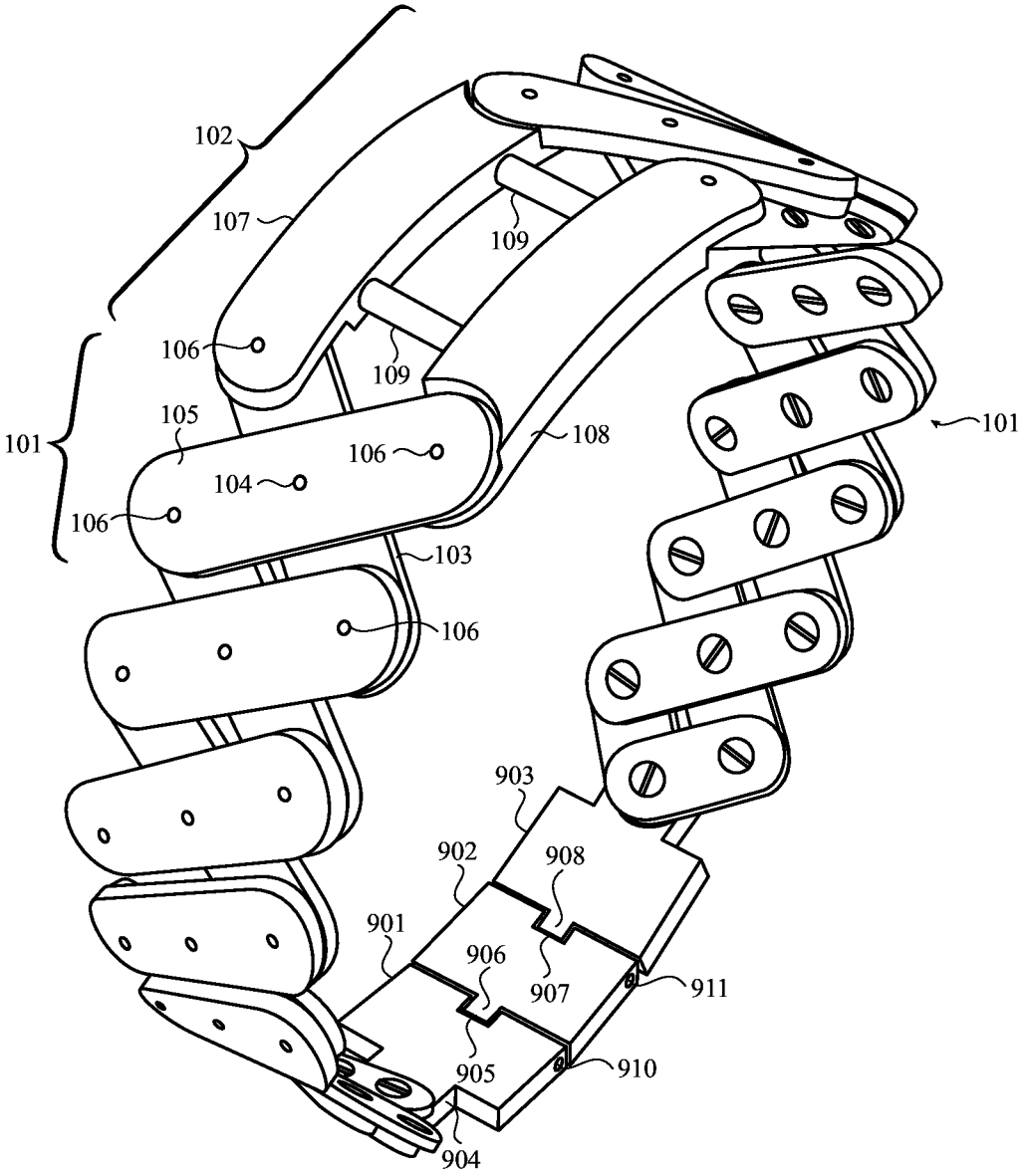
FIG. 8A is an isometric view of a fifth implementation of the first example expandable band.

For example, FIG. 8A is an isometric view of a fifth implementation of the first example expandable band 100. In this implementation, the expandable band 100 may include an adjustable length band segment made up of extender band segment links 901-903. The extender band segment links 901-903 may be coupled to the expandable links 101 (and/or other components of the expandable band 100) by attachment elements 904. The length of the adjustable length band segment made up of the extender band segment links 901-903 may be adjustable by removing at least one of the extender band segment links 901-903 and/or adding one or more other extender band segment links (at least one band segment link).

As illustrated, the extender band segment links 902 and 903 include tongues 906 and 908 that respectively mate with grooves 905 and 907 of the extender band segment links 901 and 902. As also illustrated, the extender band segment links 901 and 902 include screws 910 and 911 that are operable to secure and/or release (by insertion and/or removal of the screws 910 and 911) the extender band segment links 901-903 by respectively coupling the tongue 906 to the groove 905 and/or the tongue 908 to the groove 907.

Figure 8B:
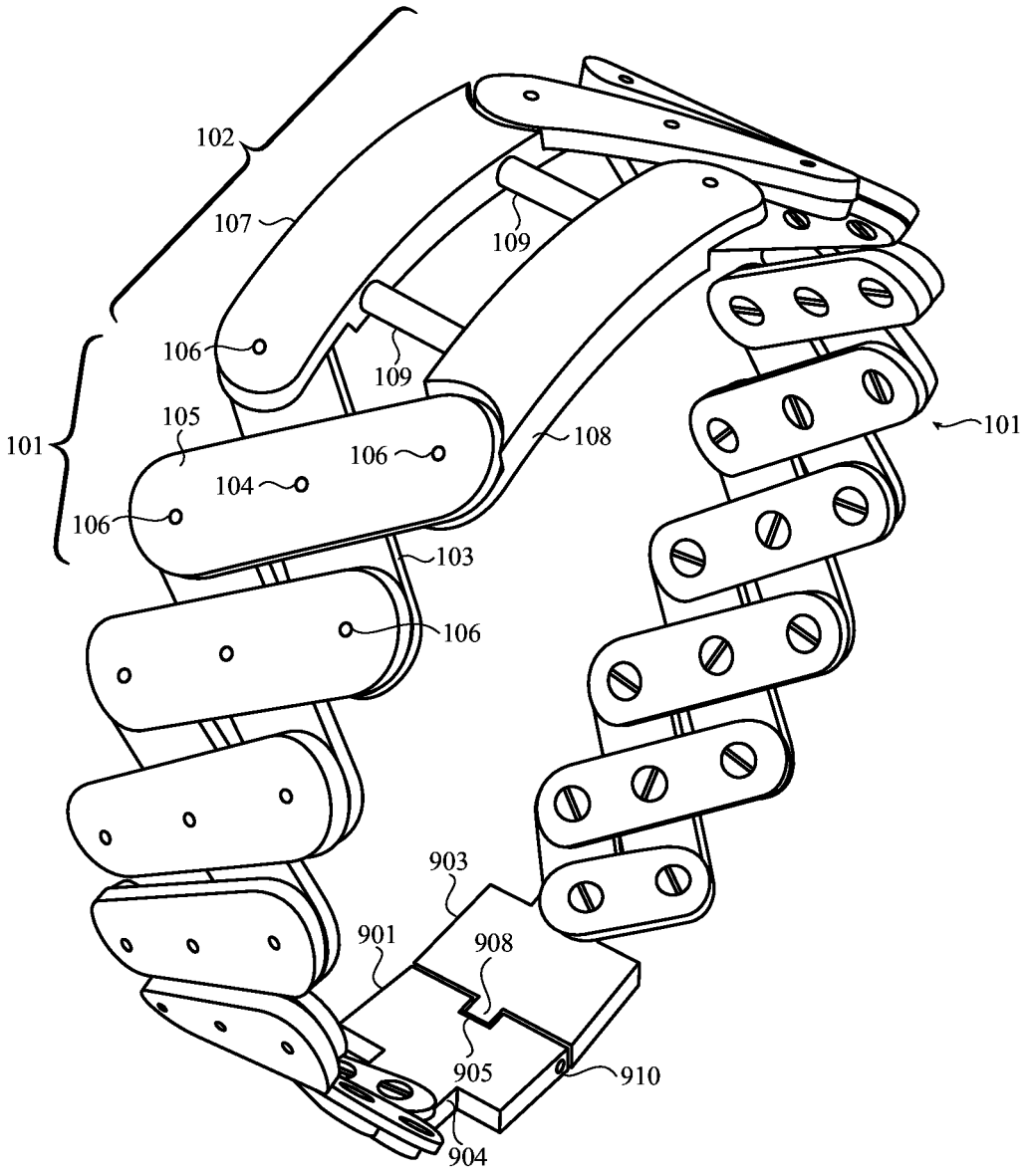
FIG. 8B illustrates the fifth implementation of the first example expandable band of FIG. 8A with one of the extender band segment links removed.

FIG. 8B illustrates the fifth implementation of the first example expandable band 100 of FIG. 8A with the extender band segment link 902 removed. As illustrated, the extender band segment links 901 and 903 are now directly connected via the tongue 908, groove 905, and the screw 910. In this way the length of the expandable band 100 may be adjusted without expanding or contracting the expandable band 100.

Figure 9:
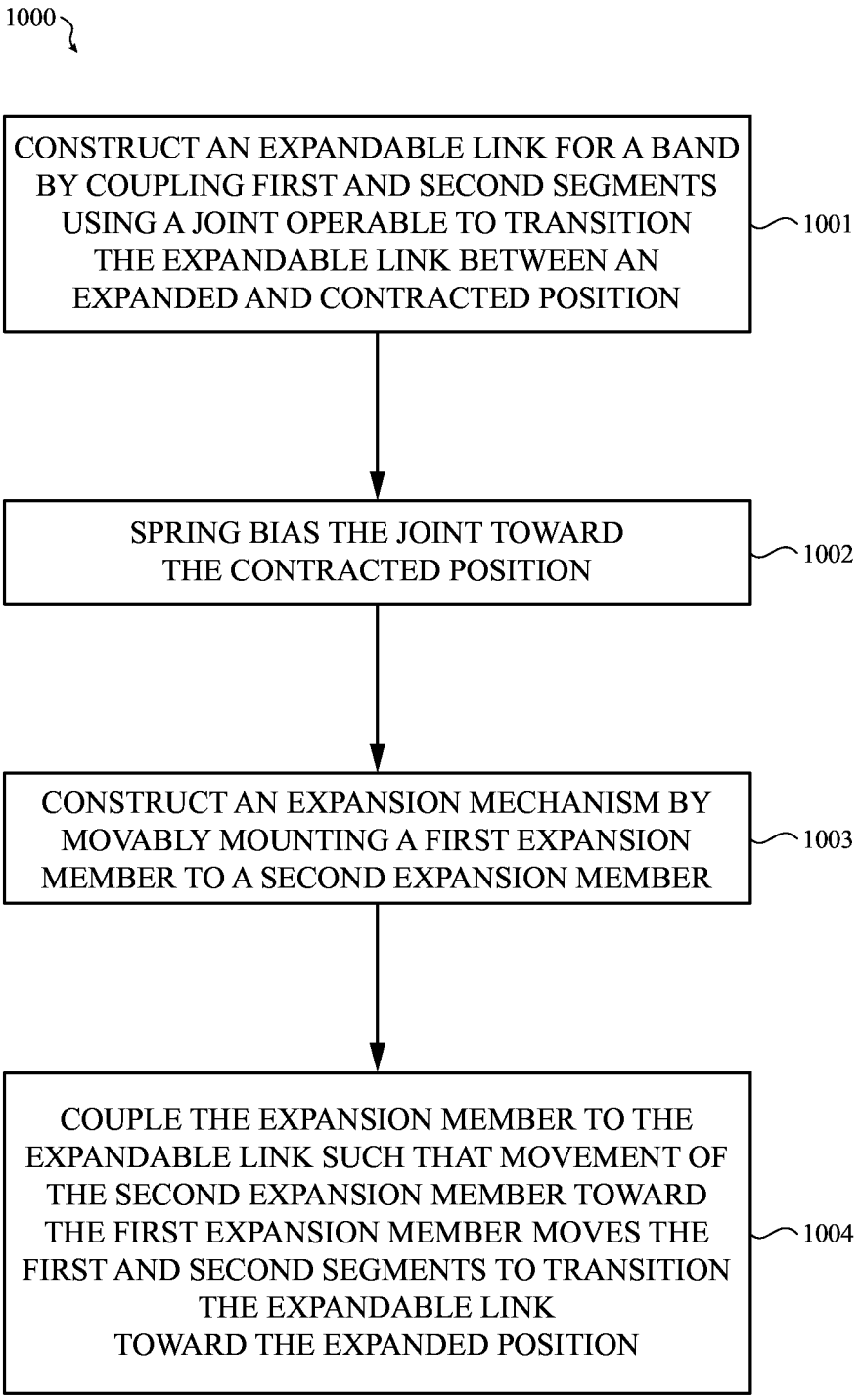
FIG. 9 is a method diagram illustrating an example method for assembling an expandable band. This method may assemble one or more of the expandable bands illustrated in FIGS. 1-8B.

FIG. 9 is a method diagram illustrating an example method 1000 for assembling an expandable band. This method may assemble one or more of the expandable bands illustrated in FIGS. 1-8B.

The flow may begin at block 1001 where an expandable band link for a band is constructed by coupling first and second segments using a joint. The first and second segments may be coupled such that the joint is operable to transition the expandable band link between one or more expanded positions and one or more contracted positions. The flow may then proceed to block 1002.

At block 1002, the joint may be spring biased. The spring bias may bias the expandable band link toward the contracted position. The flow may then proceed to block 1003.

At block 1003, an expansion mechanism may be constructed by mounting a first expansion mechanism member to a second expansion mechanism member. The first and second expansion mechanism members may be movably mounted such that the first and second expansion mechanism members are operable to move closer together and further apart. The flow may then proceed to block 1004.

At block 1004, the expansion member may be coupled to the expandable link. The expansion member may be coupled to the expandable link such that movement of the first and second expansion mechanism members with respect to each other is operable to transition the expandable link between the expanded and contracted positions. For example, movement of the second expansion mechanism member toward the first expansion mechanism member may move the first and second segments to transition the expandable link towards the expanded position.

Although the example method 1000 is illustrated and described as including particular operations performed in a particular order, it is understood that this is an example. In various implementations, various orders of the same, similar, and/or different operations may be performed without departing from the scope of the present disclosure.

For example, block 1002 is illustrated and described as spring biasing the joint of the expandable band link. However, in various implementations the joint may not be spring biased. Instead, in some implementations the expandable link may be coupled to the expansion member by one or more spring biased joints. Various configurations are possible and contemplated without departing from the scope of the present disclosure.

As described above and illustrated in the accompanying figures, the present disclosure relates to expandable bands. An expandable band may include or more expandable links and one or more expansion mechanisms. The expansion mechanisms may be operable to transition the expandable links between expanded and contracted positions. The expandable link may include multiple segments coupled by one or more joints moveable to transition the segments between expanded and contracted positions. The joints may be spring biased toward the contracted position. The expansion mechanism may include a number of expansion members movably mounted together. Movement of the expansion members with respect to each other may transfer the motion to the expandable links, transitioning the expandable links between the expanded and contracted positions. In this way, the expandable band may be expanded and/or contracted when desired yet may not expand and/or contract when this is not desired.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. An expandable band, comprising:
an expandable link, comprising:
a first segment;
a second segment; and
a joint spring joining the first segment and the second segment and operable to transition the expandable link between an expanded position and a contracted position, the joint spring biased toward the contracted position; and
an expansion mechanism coupled to the expandable link, comprising:
a first expansion mechanism member; and
a second expansion mechanism member non-rotationally mounted to the first expansion member;
wherein the first segment and the second segment move via the joint spring to transition the expandable link between the expanded position and the contracted position in response to movement of the second expansion mechanism member relative to the first expansion mechanism member.

2. The expandable band of claim 1, wherein the expansion mechanism further comprises a restrictor that is adjustable to configure a maximum separation distance between the first expansion mechanism member and the second expansion mechanism member.

3. The expandable band of claim 2, wherein the maximum separation distance between the first expansion mechanism member and the second expansion mechanism member limits movement of the expandable link toward the contracted position.

4. The expandable band of claim 1, wherein the joint spring includes a torsion spring.

5. The expandable band of claim 1, further comprising an attachment mechanism coupled to one of the expandable link or the expansion mechanism that is operable to couple the expandable band to a wearable device.

6. An expandable band, comprising:
an expandable link, comprising:
a first segment and a second segment connected to each other at the centers of the first and second segments;
a joint movably connecting the first and second segments operable to expand and contract the expandable link, wherein a biasing member biases the joint biased towards contracting the expandable link; and
an expansion mechanism, comprising:
first expansion mechanism member movably coupled to the first segment; and
a second expansion mechanism member movably mounted parallel to the first expansion mechanism member and movably coupled to the second segment;
wherein linear movement of the first and second expansion mechanism members towards each other moves the first and second segments causing the expandable link to expand.

7. The expandable band of claim 6, further comprising a band segment coupled to one of the expandable link or the expansion mechanism.

8. The expandable band of claim 7, wherein a length of the band segment is adjustable.

9. The expandable band of claim 8, wherein the length of the band segment is adjustable by adding or removing at least one band segment link.

10. The expandable band of claim 6, wherein the joint comprises at least one of a ball joint or a pin joint.

11. The expandable band of claim 6, wherein the joint includes a torsion spring that biases the joint towards contracting the expandable link.

12. The expandable band of claim 6, further comprising an additional expandable link coupled to the expandable link.

* * * * *